United States Patent [19]

Ishikawa et al.

[11] 4,345,156

[45] Aug. 17, 1982

[54] IONIZATION CHAMBER TYPE X-RAY DETECTOR

[75] Inventors: Isao Ishikawa, Hino; Hiroshi Kanda, Tokorozawa; Shinji Yamamoto, Hachioji, all of Japan

[73] Assignee: Hitachi Medical Corporation, Tokyo, Japan

[21] Appl. No.: 194,817

[22] Filed: Oct. 7, 1980

[30] Foreign Application Priority Data

Oct. 8, 1979 [JP] Japan ..... 54-128941

[51] Int. Cl.[3] ..... G01T 1/18; G01N 21/00

[52] U.S. Cl. ..... 250/385; 378/19

[58] Field of Search ..... 250/370, 371, 374, 385, 250/445 T; 313/93

[56] References Cited

U.S. PATENT DOCUMENTS

| | | | |
|---|---|---|---|
| 3,385,988 | 5/1968 | Hyun | 250/385 |
| 4,031,396 | 6/1977 | Whetten et al. | 250/385 |
| 4,158,774 | 6/1979 | Stokes | 313/93 |

FOREIGN PATENT DOCUMENTS

| | | | |
|---|---|---|---|
| 55-82976 | 6/1980 | Japan | 250/385 |
| 55-100640 | 7/1980 | Japan | 313/93 |

*Primary Examiner*—Davis L. Willis
*Assistant Examiner*—Janice A. Howell
*Attorney, Agent, or Firm*—Craig and Antonelli

[57] ABSTRACT

In an ionization chamber type X-ray detector used in a computerized X-ray tomography device, non-insulative material such as semiconductive or conductive material is provided on each of paired electrode supporting plates for supporting anode and cathode electrodes, whereby the electrification of the electrode supporting plate may be prevented so that a signal current can be exactly and stably detected.

7 Claims, 23 Drawing Figures

IONIZATION CHAMBER TYPE X-RAY DETECTOR

BACKGROUND OF THE INVENTION

This invention relates to an ionization chamber type X-ray detector adapted especially for use in a computerized X-ray tomography device.

For such a tomography device has been hitherto used an ionization chamber type detector which measures the spatial distribution of X-rays. The schematic structure of this detector is as shown in FIG. 1. Referring to the figure, alternate parallel flat anode and cathode electrodes 2 and 3 with a predetermined inverval defined therebetween are disposed between a pair of parallel electrode supporting plates 1 (made of, for example, insulating material). For practical use, this structure is placed in the atmosphere of heavy-atom gas (e.g. Xenon) kept at about 10–50 atmospheric pressures. X-ray coming on in the direction as shown by an arrow in FIG. 1, make interactions with the gas to produce photoelectron-ion pairs. Under the presence of an electric field, the photoelectrons are collected onto the anodes 2 while the ions are gathered by the cathodes 3. Accordingly, through a pair of anode and cathode electrodes flows a current proportional to the intensity of X-rays in the vicinity of these electrodes.

FIG. 2 shows a somewhat detailed structure of the electrode assembly in the ionization chamber type X-ray detector shown in FIG. 1. As shown in FIG. 2, the two electrode supporting plates 1 of insulating material, a surface of each plate being provided with grooves 5 arranged with a predetermined interval are disposed with a fixed spacing therebetween. The anode and cathode electrodes 2 and 3 are alternately inserted in these grooves. The ends of each electrode are cemented by binding agent 4 in the grooves 5. The space between a pair of anode and cathode electrodes 2 and 3 defines one detector element of the ionization chamber type X-ray detector.

With this type of X-ray detector, the electrode-electrode distance d must be decreased to increase the density of the detector elements. This necessitates the reduction in the creepage distance along the surface of the insulator. Accordingly, it is difficult to maintain the insulating resistance between the anode 2 and the cathode 3 at a large value. Namely, the dark current from the anode 2 flows via the surface of the insulator into the cathode 3 so that it is impossible to derive a signal current stably from the cathode 3.

FIG. 3 shows an example of the ionization chamber type X-ray detector which can solve the above problem. An electrode supporting plate 1 comprises an insulating member 7 (e.g. of glass) and a conductive member 6 disposed on the insulating member 7 with its contact surface 11 rigidly bound to the member 7, a plurality of grooves 5 being cut at a predetermined interval in the insulating member 7 and the bottom of each groove reaching the contact surface of the conductive member 6. Two such electrode supporting plates 1 (in FIG. 3 only one of them is shown for convenience' sake) are arranged at a distance from each other. The ends of the anode and cathode electrodes 2 and 3 are alternately inserted in the grooves 5 and the plates 1 serve to support these electrodes 2 and 3. As shown in FIG. 3, only one side surface of each of these electrodes is bound to the side surface of a groove 5 with adhesive agent 8 which may be a thermoplastic resin.

With the above-described structure in which a gap is left between the other side surface of the electrode and the side wall of the groove 5, the dark current flowing out of the anode 3 along the surface of the insulating member 7 flows along a path indicated by an arrow 9 into the conductive member 6. Therefore, if the conductive member 6 is grounded, the dark current which might otherwise flow from the anode 2 into the cathode 3, can be eliminated so that the output signal can be detected stably.

The X-ray detector having such a structure as described above has proved, according to the present inventors' experiments, to have the following properties.

Namely, the surface condition of the insulating material largely affects the dark current flowing along the surface of the insulating member. For instance, if the surface is locally contaminated due to an incomplete cleaning of the surface after groove cutting or due to a worker's carelessness during assembling process, the surface resistance of the stained surface portion will increase to increase the dark current flowing therethrough. This causes the uneven distribution of potentials developed over the surface of the insulating member of the electrode supporting plate 1. Accordingly, this uneven distribution of potentials affects electrons flowing into the cathodes 3 so that small undesirable variations appear in the outputs from the respective cathodes 3.

Even, if all or a part of the surface of the insulating member is completely clean and if there is no dark current in the region, photoelectrons generated in the detector may be accumulated on the insulating member surface and therefore cause the surface to be electrified. Moreover, since this phenomenon of electrification fluctuates with time, the distribution of potentials over the insulating member surface is disordered again, which also affects the electrons flowing into the cathodes 3 so that the outputs of the cathodes 3 would contain small fluctuations.

SUMMARY OF THE INVENTION

An object of this invention is to provide an ionization chamber type X-ray detector in which the distribution of potentials over the surface of the electrode supporting plate is uniform and the electrification due to charge accumulation is prevented so that a signal current can be exactly and stably detected.

This invention which has been made to attain the above object, is characterized in that the surface portion of the electrode supporting plate between grooves for receiving the ends of electrodes is non-insulative, i.e. semiconductive or conductive.

DESCRIPTION OF THE PREFERRED EMBODIMENTS

Embodiments of this invention will now be described with reference to the accompanying drawings.

Figure 1:
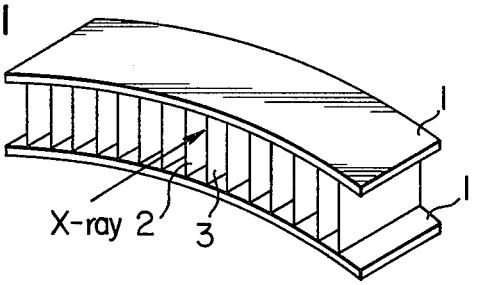
FIG. 1 PRIOR ART
FIG. 1 shows a schematic structure of a conventional ionization chamber type X-ray detector.
Figure 2:
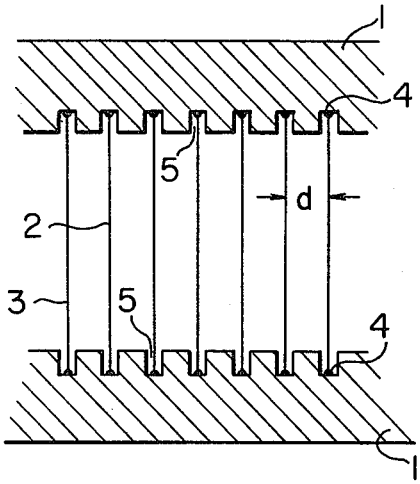
FIG. 2 PRIOR ART
FIGS. 2 and 3 respectively show schematic structures of the main portions of conventional ionization chamber type X-ray detectors.
Figure 3:
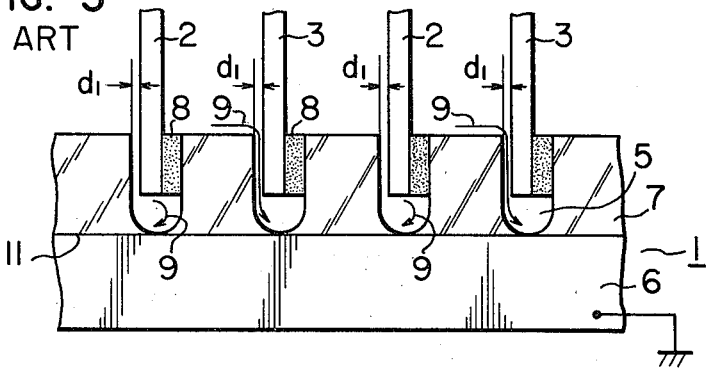
FIG. 3 PRIOR ART
Figure 4:
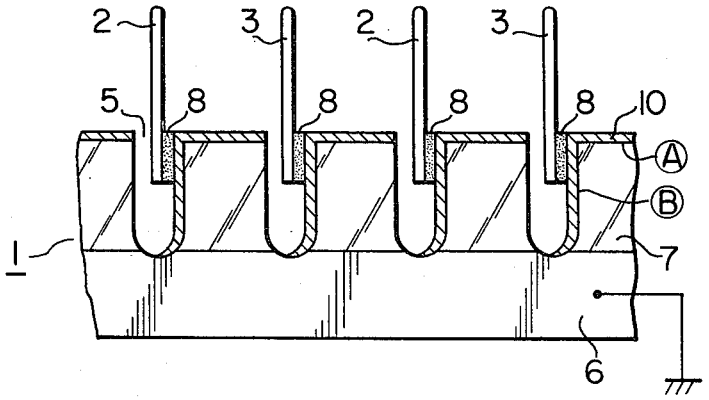
FIG. 4 shows a structure of the main portion of an ionization chamber type X-ray detector according to an embodiment of this invention.

FIG. 4 shows an ionization chamber type X-ray detector according to a first embodiment of this invention. An electrode supporting plate 1 comprises an insulating member 7 (e.g. of glass) and a conductive member 6 (e.g. of metal) bonded thereto. In the electrode supporting plate 1 are formed grooves 5 which are distanced at a predetermined interval from each other and each of which reaches the conductive member 6. The surface Ⓐ of the insulating member 7 and one side wall Ⓑ of each groove 5 are coated with a semiconductive film 10 (of a material having a resistivity of $10^3$–$10^8$ Ω·cm). Two such electrode plates 1 (in FIG. 4, only one is shown for convenience' sake) are disposed with a fixed spacing therebetween and the ends of platelike anode and cathode electrodes 3 are alternately inserted in the grooves 5. The electrode supporting plates 1 thus support the anode and cathode electrodes. Namely, only one side surface of each electrode is secured to the semiconductive film coated side wall Ⓑ of the groove 5 by means of adhesive agent 8. The adhesive agent 8 may include a thermoplastic resin such as a polytetrafluoroethylene resin or a copolymer resin of ethylene tetrafluoride and propylene hexafluoride.

Figure 5A:
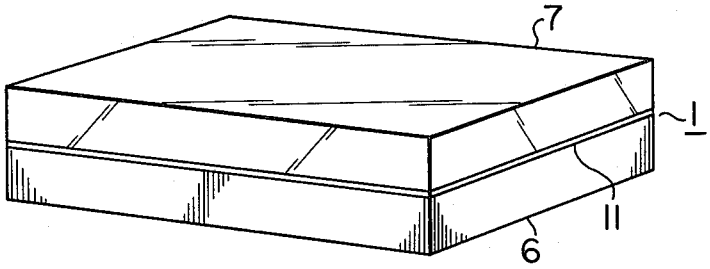
FIGS. 5*a* to 5*c* and 6*a* to 6*c* illustrate the sequential steps of a process for fabricating the ionization chamber type X-ray detector shown in FIG. 4.
Figure 5B:
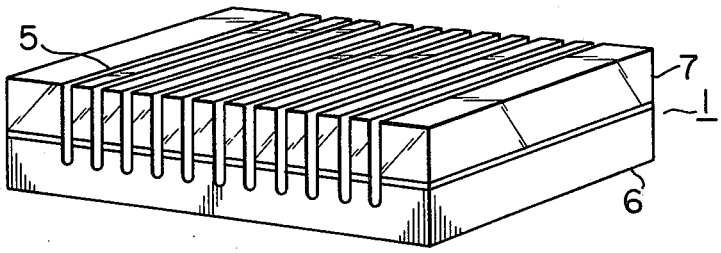
Figure 5C:
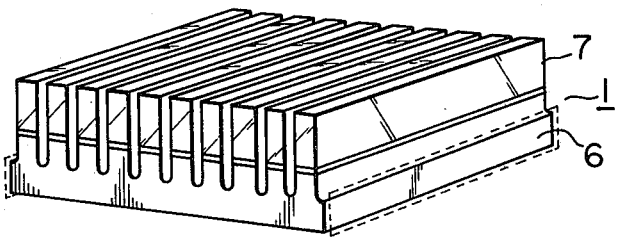
Figure 6A:
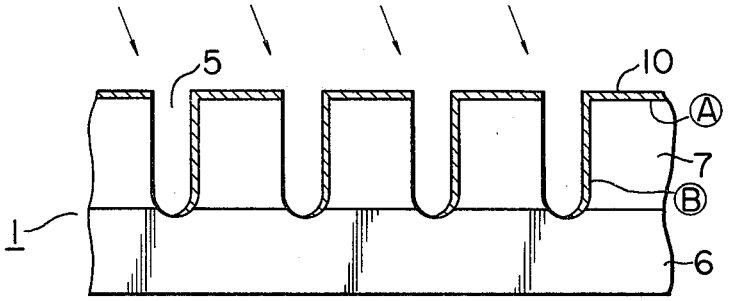
Figure 6B:
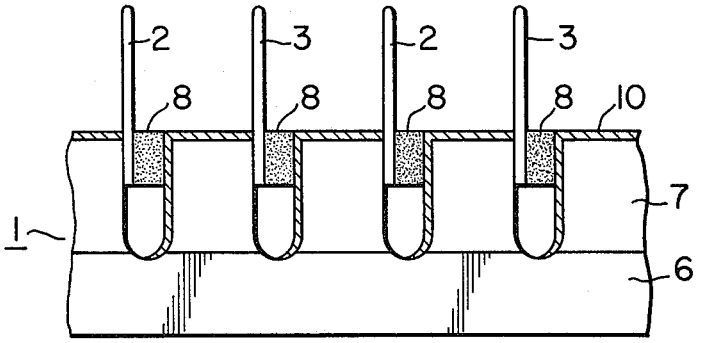

FIGS. 5*a* to 5*c* and 6*a* to 6*c* show the sequential steps of a process for fabricating an X-ray detector shown in FIG. 4. As shown in FIG. 5*a*, an electrode supporting plate 1 is provided a conductive member 6 and an insulating member 7 rigidly bonded to each other by means of bonding agent applied to the contact surfaces 11 of them. As shown in FIG. 5*b*, a plurality of grooves 5 with a predetermined interval defined therebetween are formed in the insulating member 7 by a cutting machine (e.g. multi-wire chainsaw) so that they reach the conductive member 6. The electrode supporting plate 1 resulting from the grooving step is such that pieces of the insulating member 7 are arranged with a predetermined interval therebetween on the conductive member 6 and the conductive member material is exposed between the adjacent insulating pieces. After the grooving step, the edge portions of the electrode supporting plate 1 are shaped as shown in FIG. 5*c*. Next, as shown in FIG. 6*a*, semiconductive material 10 is vapor-deposited on the grooved plate 1 in a direction as indicated by arrows. For example, the vapor-deposition of Ti, Cu, Ni or V in the atmosphere of oxygen may form an oxide film $TiO_2$, CuO, NiO or $V_2O_5$ having a resistivity of $10^8$ Ω·cm, $10^6$ Ω·cm, $10^4$ Ω·cm or $10^5$ Ω·cm, respectively. As a result, the electrode supporting plate 1 with the surface Ⓐ of the insulative member and only one side wall Ⓑ of each groove 5 coated with the semiconductive film 10 is fabricated.

Figure 6C:
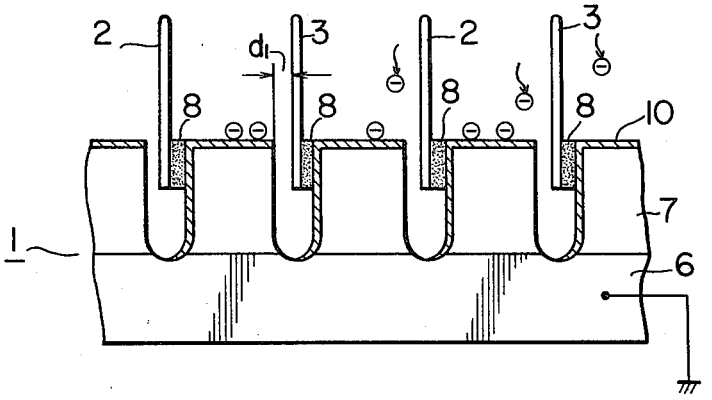

Two such electrode supporting plates 1 are positioned opposite to each other with their grooved surfaces facing each other, and anode and cathodes electrodes 2 and 3 are alternately inserted in the grooves 5. Then, stripes of thermoplastic resin 8 are interposed between the electrodes and the side walls of the grooves, as shown in FIG. 6*c*.

The thus prepared plates 1 are heated up to a desired temperature (near the softening temperature of the resin 8) in a furnace. The thermoplastic resin 8 may be a polytetrafluoroethylene resin, a vinylidene fluoride resin, an ethylene trifluorochloride resin, and a copolymer resin of ethylene tetrafluoride and propylene hexafluoride. After the above heat treatment (280°–290° C.), the thermoplastic resin 8 secures the electrode rigidly to the semiconductive film 10, with a sufficient electric resistivity of $10^{14}$ Ω·cm therebetween. FIG. 6*c* shows in detail the secured portions. After the heat treatment, the thermoplastic resin contracts a little due to heat so that a gap $d_1$, as small as about 0.01–0.02 mm, is defined between the insulating member 7 and the electrode 2 or 3.

As described above, with the electrode supporting plates 1 each having its surface coated with the semiconductive film and also having gaps between the insulating member 7 and the surfaces of the electrodes, the dark current flowing from the anode 2 along the surface of the thermoplastic resin 8 passes through the semiconductive film 10 to the conductive member 6. Therefore, if the conductive member 6 is grounded, the dark current flowing from the anode 2 to the cathode 3 is short-circuited to the ground by the exposed portion of the conducting member 6, whereby no dark current flows into the cathode 3. Moreover, to cover the surface of the electrode supporting plate with the semiconductive film enables the surface of the plate to be kept clean. Also, as shown in FIG. 6*c*, even when photoelectrous ⊖ produced through the ionization of Xenon gas by X-rays hit without recombination onto the surface of the electrode supporting plate 1, the electrification of the surface of the plate due to the accumulation of the photoelectrons is prevented since the surface of the plate 1 is grounded via the semiconductive film 10.

Figure 7A:
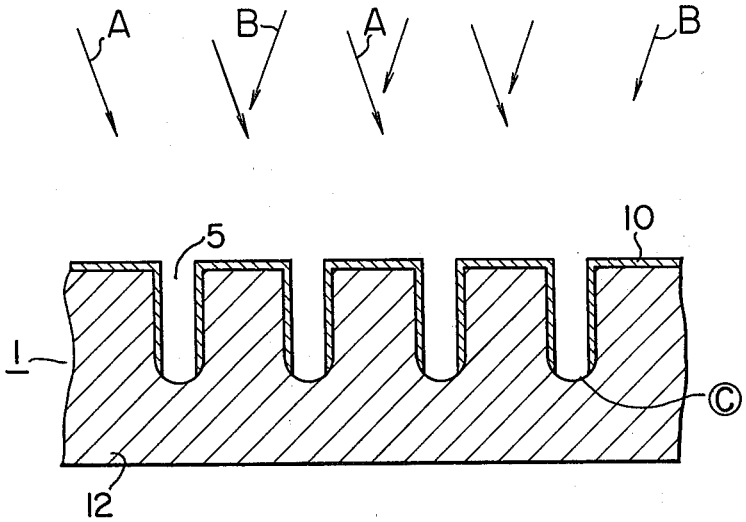
FIGS. 7*a* and 7*b* show a structure of the main part of an ionization chamber type X-ray detector according to another embodiment of this invention, along with the process steps for fabricating the structure.
Figure 7B:
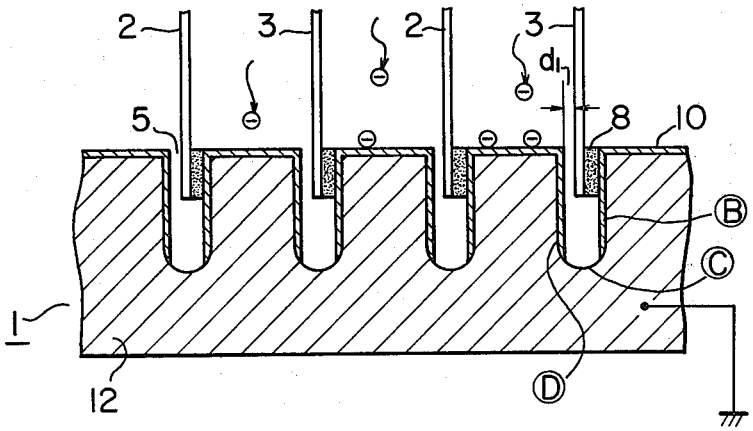

FIGS. 7*a* and 7*b* show a second embodiment of this invention, along with the steps of a process for fabrication thereof. An electrode supporting plate 1 is made of conductive material 12 (e.g. vitrifiable or glassy carbon or metal) and grooves 5 are formed with a predetermined interval therebetween in the conductive member 12 by a cutting machine. After the grooving step, semiconductive material 10 is vapor-deposited on the conductive member 12 to a desired thickness, first in a direction indicated by arrows A and secondly in a direction of arrows B, as shown in FIG. 7*a*. Accordingly, as shown, the electrode supporting plate 1 is finished wherein the conductive member 12 is exposed only at the bottom Ⓒ of each groove 5 and the remaining surface portion of the member 12 is coated with the semiconductive film 10.

Next follows the steps of positioning two such electrode supporting plates, inserting electrodes in the grooves and applying thermoplastic resin but since these steps are the same as in the above-described first embodiment, the explanation thereof will be omitted.

FIG. 7*b* shows the state in which the electrodes 2 and 3 are secured by thermoplastic resin 8 to the electrode supporting plate 1 in accordance with the electrode securring step described with the first embodiment. The resultant electrode supporting plate 1 consists of the conductive member 12 having plural grooves 5 with a predetermined interval defined therebetween, the conductive member 12 being coated with the semiconductive film 10, except at the bottom Ⓒ of each groove 5. The alternate anode and cathode electrodes 2 and 3 are secured by the adhesive agent 8 to one-side walls Ⓑ of the grooves 5 with a gap $d_1$ defined between the electrode and the other-side wall Ⓓ of the groove 5. If the conductive member 12 is grounded, the dark currents from the anodes 2 flow to the earth and also electrous ⊖ impinging onto the surface of the plate 1 flow into the earth. Consequently, the electrification of the electrode supporting plate can be prevented.

According to this embodiment, the semiconductive film 10 serves not only to lead to the earth the dark current flowing from the anode to the cathode and the electrons impinging onto the supporting plate, but also to prevent discharge from taking place between the anode and the supporting plate (conductive member). Further, there is no need for a step of bonding any insulating member and the conductive member 12 together and therefore the fabrication of the electrode supporting plate can be facilitated. Furthermore, the problem of the insulating member peeling off the conductive member during the step of cutting grooves by a cutting machine or the problem of the insulating member (glass) being damaged due to the impact carelessly applied thereto by the worker during assemblage, can be completely eliminated.

Figure 8A:
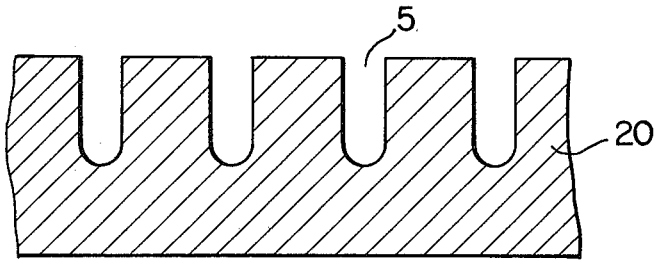
FIGS. 8*a* to 8*c* and FIGS. 9*a* to 9*d* respectively show the steps of other processes for fabricating an electrode supporting plate used in this invention.
Figure 8B:
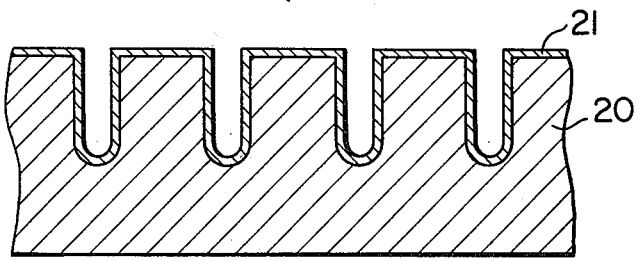
Figure 8C:
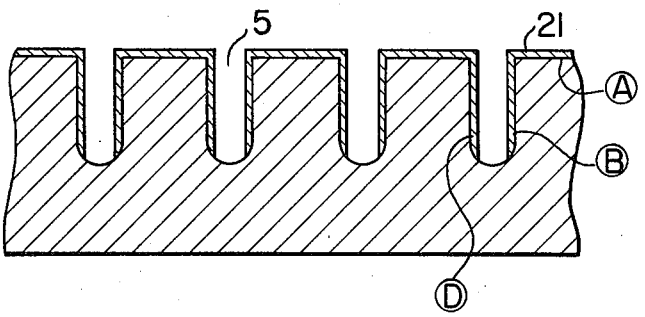

If the conductive member 12 of the electrode supporting plate is made of aluminum or the like which forms a stable oxide film on its surface, the electric insulating property between the electrodes 2 and 3 can be improved. Namely, as shown in FIG. 8*a*, an aluminum plate 20 is prepared with grooves 5 distanced at a predetermined interval from each other. Then, as shown in FIG. 8*b*, an oxide film 21 is uniformly formed on the surface of the plate 20. As shown in FIG. 8*c*, the portions of the oxide film 21 at the bottoms of the grooves 5 are thereafter removed by, for example, a cutting machine so that aluminum is exposed there. The electrode supporting plate fabricated through the above-described process has its surface Ⓐ and the side walls Ⓑ and Ⓓ of every groove coated with oxide film (insulating film). Semiconductive material is thereafter vapor-deposited on the surface Ⓐ and the side wall Ⓑ alone, and each electrode is secured to the groove side wall Ⓑ coated with the semiconductive film by thermoplastic resin. With the thus obtained detector, the electric insulation is provided by the cooperation of the oxide film and the thermoplastic resin so that the insulation of each electrode can be much improved.

Figure 9A:
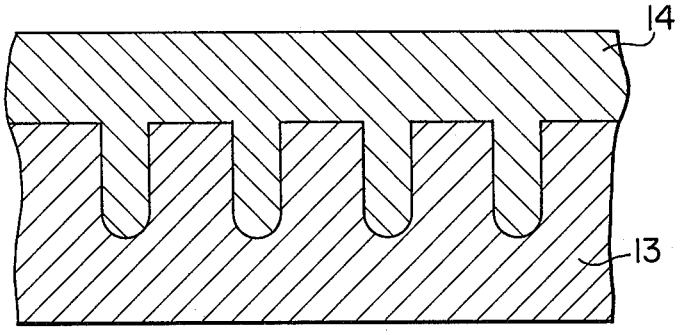
Figure 9B:
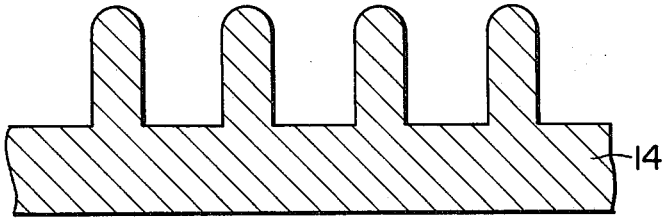

FIGS. 9*a* to 9*d* show a process of forming an electrode supporting plate by the use of a mold. First, an exact copy 13 of a desired electrode supporting plate is prepared by cutting grooves at a predetermined interval in a flat plate (e.g. of metal) by a cutting machine. As shown in FIG. 9*a*, fluidized material 14 (e.g. plaster or plastic) for a casting mold is poured into the exact copy 13, solidified there, and then separated from the copy 13. Accordingly, the mold material 14 having a shape complementary to that of the copy 13 can be obtained.

Figure 9C:
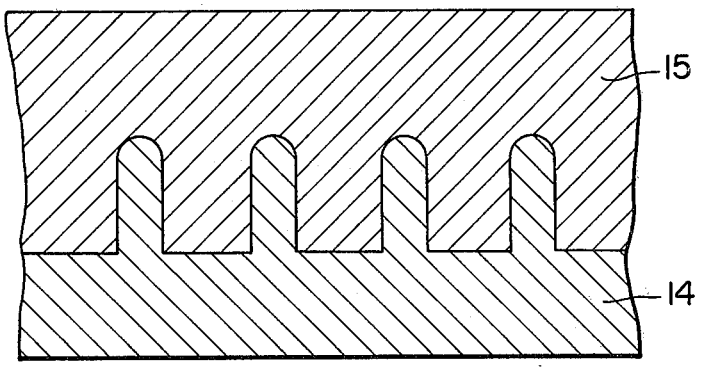
Figure 9D:
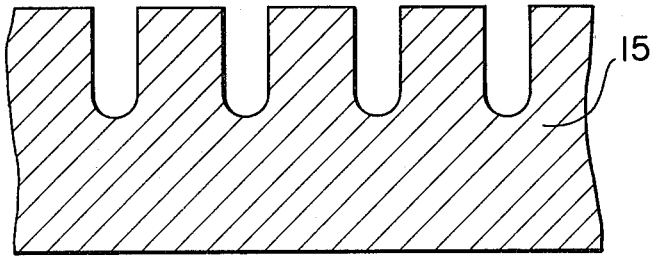

As shown in FIG. 9*c*, an organic material 15 is poured to a desired thickness into the thus prepared mold (female mold) 14 thus prepared and dried up by heating. The organic material is separated from the mold 14 so that the organic material 15 assumes the same shape as the exact copy 13, as shown in FIG. 9*d*.

The present inventors have found that a mixture of furfural ($C_5H_4O_2$) and pyrrole ($C_4H_5N$) is suitable for the organic material 15 and that if the mixing ratio of furfural to pyrrole is 4:6, an optimal viscosity is attained and also the carbon yield is excellent in the sintering carbonification process performed later. A volume of chloric acid (36% concentration) is diluted by distilled water to four to five times the volume of the original HCl and the mixture of furfural and pyrrole with 1–3% of this diluted HCl added thereto is used as catalizer for polymerization. When the mixture is stirred while heated up to 50°–80° C., polymerization takes place in about 2–10 minutes. After the polymerization reaction, the mixture becomes viscous fluid.

This viscous polymer liquid is poured into the mold 14 and the temperature of the polymer is elevated through a preliminary heating at a rate of at most 0.5° C./minute up to 80° C. in the air. Then, the organic material 15 is separated from the mold 14 and heated up to 450° C. in vacuum so as to complete the hardening process.

Next, the hardened organic material 15 is heated in vacuum up to 100° C. at a temperature elevating rate of about 10° C./min. and then heated finally up to 1300°–2500° C. so that the organic material is turned into amorphous carbon. Thus, an electrode supporting plate made of amorphous carbon is obtained.

The electrode supporting plate thus prepared has an electric conductivity (about $10^{-4}$ Ω·cm) and therefore, according to the fabrication process described with the second embodiment described above, coated with semiconductive film. And such a detector as shown in FIG. 7*b* is obtained by fixing respective electrodes to the plate.

The electrode supporting plate embodying this invention can be thus fabricated by the use of a mold through a casting technique and therefore a great number of such plates having the same shape can be manufactured. Consequently, according to the present method, the time required for cutting grooves can be much shortened in comparison with the conventional method using a grooving machine and moreover it is possible to manufacture X-ray detectors having uniform characteristics.

The above description is concentrated on the manufacturing method wherein vitrifiable carbon made from a mixture of furfural and pyrrole is used as the base of the electrode supporting plate, but such a plate can also be fabricated by the use of other vitrifiable carbon commercially available under the trade name "Glassy Carbon" or "Cellulose Carbon".

Figure 10:
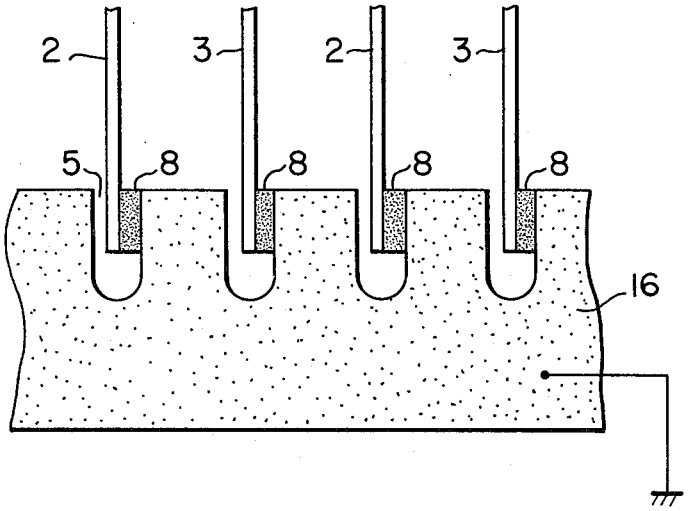
FIGS. 10 and 11 respectively show structures of the main parts of ionization chamber type X-ray detectors according to further embodiments of this invention.

FIG. 10 shows a third embodiment of this invention. In the figure, an electrode supporting plate is made of semiconductive material 16 (having a resistivity of about $10^3$–$10^8$ Ω·cm) and a plurality of grooves 5 are formed in the semiconductive material 16 at a predetermined interval.

Anode and cathode electrodes 2 and 3 are alternately located in the grooves 5 and each electrode is secured to the semiconductive material 16 by means of adhesive agent 8, only one surface of the electrode being secured to the side wall of the groove.

The difference of this embodiment from the preceding embodiments is that the electrode supporting plate as a whole is made of material having semiconductivity. With this constitution, the step of vapor-depositing semiconductive material on the surface of an electrode supporting plate can be omitted.

The electrode supporting plate made of semiconductive material, can be produced by controlling the processing temperature in the heat treatment of the organic material 15 shown in FIG. 9. Namely, the measurement of the resistivity of the organic material 15 during the heat treatment process has revealed that the resultant material exhibits a higher resistivity when treated at lower temperatures and a lower resistivity when treated at higher temperatures. For instance, the organic material 15, treated at temperatures near 400° C., has a resistivity of $10^5$–$10^7$ Ω·cm. Therefore, a mold material (e.g. plaster or plastic) is poured into an exact copy of an electrode supporting plate having equidistant grooves to form a female mold; an organic material (e.g. mixture of furfural and pyrrole) is poured into the female mold; the organic material in the female mold is subjected to a preliminary heating in the air from room temperatures up to 80° C. at a rate of 0.5° C./min or below; the organic material 15 is then removed from the female mold; the material 15 is heated in vacuum up to about 400° C.; and the material 15 is turned into semiconductive substance. As a result, an electrode supporting plate made of semiconductive material and having plural equidistant grooves cut therein can be obtained.

The detector having such a structure as shown in FIG. 10 can be obtained by securing the electrodes to the electrode supporting plates by thermoplastic resin.

As described in the above embodiments, by the use of the structure wherein the surface portion of the electrode supporting plate between the grooves for receiving the ends of the electrodes is made semiconductive and a gap is left between the side wall of a groove and an electrode therein, the dark current from the anode can be prevented from flowing into the cathode and moreover the electrode supporting plate can be prevented from being electrified by the electrons which are generated in the detector and then impinged upon the surface of the plate to be accumulated there, so that a signal current can be detected more stably.

Figure 11:
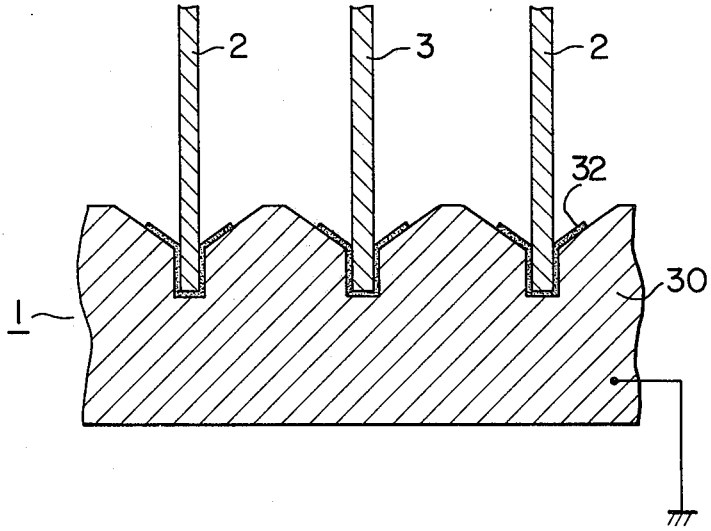

FIGS. 11 and 12 show a fourth embodiment of this invention, in which the X-ray detector has such a structure that it can be fabricated in a rather short time.

Figure 12A:
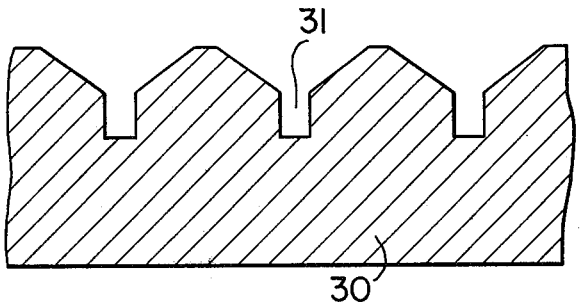
FIGS. 12*a* and 12*b* show the process steps for fabricating the electrode supporting plate used in the ionization chamber type X-ray detector shown in FIG. 11.
Figure 12B:
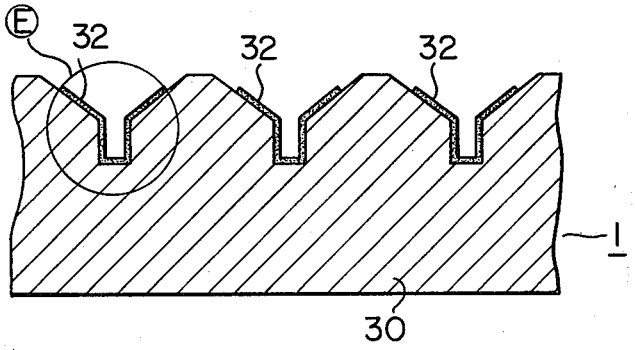

FIGS. 12*a* and 12*b* show the steps of a process for fabricating such an electrode supporting plate as shown in FIG. 11. As shown in FIG. 12*a*, an electrode supporting plate is made of conductive material 30 (e.g. vitrifiable carbon or metal) and a plurality of grooves 31 are formed at a predetermined interval in the conductive plate 30 by, for example, a cutting machine. The cross section of the groove 31 is in the shape of a cross section taken along the center axis of a funnel, i.e. lower rectangle plus upper inverted trapezoid. This type of groove can be formed first by cutting a rectangle groove and secondly by removing the brim portion with a tapered tool edge. As shown in FIG. 12*b*, after the step of grooving, thermoplastic resin 32 is applied, by, for example, electrostatic coating, to the only portions of the conductive member 30 that are indicated by Ⓔ in FIG. 12*b*. As a result of this, the electrode supporting plate 1 has its conductive material exposed between the grooves for receiving the ends of the electrodes.

The above description is concerned with a fabricating method by which electrode supporting plates are manufactured by cutting grooves with a cutting machine, but such plates as shown in FIG. 12*b* can also be manufactured through a casting technique using molds formed from an exact copy of an electrode supporting plate prepared by the above method.

Two such electrode supporting plates 1 are disposed parallel to each other and anode and cathode electrodes 2 and 3 are alternately fitted into the grooves as shown in FIG. 11. When the electrode supporting plates 1 with the amodes 2 and cathodes 3 fitted in the grooves 31 are heated up to predetermined temperatures (e.g. softening temperatures of the resin 32) in a furnace, the electrodes 2 and 3 are secured to the plate 1 by the once fused and then plasticized resin. The thermoplastic resin 32 serves not only to secure the electrodes 2 and 3 to the electrode supporting plates but also to assure electric insulation between electrodes.

As described in this embodiment, if thermoplastic resin is previously applied to predetermined portions of the electrode supporting plates, the assembling efficiency can be much improved since it is only necessary to fit the electrodes into the grooves in the assembling process.

The above description is given to the case where the interval between grooves is rather large and the thickness of each electrode is also large. In such a case, the thermoplastic resin 32 applied to the inner surface of a groove by electrostatic coating can assume a uniform thickness as shown by a circle Ⓔ in FIG. 12*b* and therefore can attain higher electrical insulation between electrodes than required value.

However, in the case where the density of the detector elements is to be increased, the interval between electrodes becomes smaller, the thickness of each electrode decreases and the width of each groove also becomes smaller. It is therefore difficult to apply thermoplastic resin to a uniform thickness entirely over the surface of each groove and pinholes may exist in the resin layer in some grooves. It is in this case difficult to maintain the electric insulation between electrodes higher than desired value.

In order to eliminate this difficulty, the electrode supporting plate should be made of metal such as, for example, aluminum which can form an oxide film on its surface, grooves having such a shape as shown in FIG. 12 should be cut, and only those portions which are to be applied with thermoplastic resin 32 should be subjected to usual anodic oxidation to form oxide films. These oxide films serve to secure the electric insulation and the thermoplastic resin 32 serves only as a binder for electrodes.

Alternatively, polyimide resin of high purity may be used instead of the oxide film. The polyimide resin has an excellent resistivity to heat and electric insulation property and can easily be formed into smooth and uniformly thick film and that without cracks or pinholes.

As described above, according to this invention, the electrode supporting plates for supporting anodes and cathodes are characterized in that conductive or semiconductive member is exposed in those portions of the plates which lie between the grooves to fit the electrodes therein. Therefore, electrons, which are generated in the detector and then impinged on the plates, are led to the earth through the conductive or semiconductive member so that the electrification of the surfaces of the electrode supporting plates can be prevented. This enables a signal current to be detected very stably.

Moreover, the capability of the electrode supporting plates being easily fabricated through a casting technique using molds, can shorten to a considerable extent the time required for completing a detector and also can manufacture on a large scale such plates having the same shape, leading to the manufacture of electrode supporting plates having a uniform characteristic.

Further, the previous application of thermoplastic material to desired portions of the plates can decrease the time required for assemblage.

We claim:

1. An ionization chamber type X-ray detector comprising:

a pair of electrode supporting plates each having a surface in which a plurality of grooves are formed with a predetermined interval from each other, that surface portion of said electrode supporting plates between said grooves being made of non-insulative material; and a plurality of plate-like anode and cathode electrodes secured to said grooves respectively through insulating medium.

2. An ionization chamber type X-ray detector as claimed in claim 1, wherein said electrode supporting plate includes an insulating member having said grooves therein and a conductive member adjacent thereto, said grooves reaching said conductive member, and said non-insulative material includes semiconductive material formed between said insulating medium and said insulating member, said semiconductive material extending to said conductive member.

3. An ionization chamber type X-ray detector as claimed in claim 1, wherein said electrode supporting plate includes a conductive member having said grooves therein, and said non-insulative material includes semiconductive material formed between said insulating medium and said conductive member.

4. An ionization chamber type X-ray detector as claimed in claim 1, wherein said electrode supporting plate includes a conductive member having said grooves therein and a film of the oxide of said conductive member formed on the inner surface of each of said grooves except at the bottom thereof, and said non-insulative material includes semiconductive material formed between said insulating medium and said oxide film.

5. An ionization chamber type X-ray detector as claimed in claim 1, wherein said electrode supporting plate includes a semiconductive member having said grooves therein, said semiconductive member serving as said non-insulative material.

6. An ionization chamber type X-ray detector as claimed in claim 1, wherein said electrode supporting plate includes a conductive member having said grooves therein, said conductive member serving as said non-insulative material.

7. An ionization chamber type X-ray detector as claimed in claim 6, wherein said conductive member has a film of the oxide thereof only in the surface regions on which said insulating medium exists.

* * * * *